US007463218B2

(12) United States Patent
Yun et al.

(10) Patent No.: US 7,463,218 B2
(45) Date of Patent: Dec. 9, 2008

(54) METHOD AND APPARATUS FOR DRIVING PLASMA DISPLAY PANEL

(75) Inventors: Sang Jin Yun, Kyoungsangbuk-do (KR); Seong Ho Kang, Daegu (KR)

(73) Assignee: LG Electronics Inc., Seoul (KR)

( * ) Notice: Subject to any disclaimer, the term of this patent is extended or adjusted under 35 U.S.C. 154(b) by 483 days.

(21) Appl. No.: 10/673,282

(22) Filed: Sep. 30, 2003

(65) Prior Publication Data

US 2004/0066356 A1 Apr. 8, 2004

(30) Foreign Application Priority Data

Oct. 2, 2002 (KR) ..... 10-2002-0060042
Sep. 27, 2003 (KR) ..... 10-2003-0067170

(51) Int. Cl.
*G09G 3/28* (2006.01)
*G09G 3/10* (2006.01)
*H01J 7/24* (2006.01)
*H05B 31/26* (2006.01)

(52) U.S. Cl. ..... 345/60; 315/169.4; 345/63

(58) Field of Classification Search ..... 345/60–72; 315/169.4, 84.51, 111.21, 111.31, 111.41, 315/111.51, 111.61, 111.71
See application file for complete search history.

(56) References Cited

U.S. PATENT DOCUMENTS 6,466,187 B1 * 10/2002 Moon ..... 345/63
6,630,796 B2 * 10/2003 Tokunaga et al. ..... 315/169.4
6,756,977 B2 * 6/2004 Ide ..... 345/212
6,768,479 B2 * 7/2004 Nakamura ..... 345/60
7,023,406 B1 * 4/2006 Nunomura et al. ..... 345/63
7,180,482 B2 * 2/2007 Homma ..... 345/66
2001/0006378 A1 7/2001 Kasahara et al. ..... 345/60
2002/0021264 A1 2/2002 Nakamura ..... 345/60
2004/0164930 A1 * 8/2004 Hashimoto et al. ..... 345/60

FOREIGN PATENT DOCUMENTS

JP 09-034403 2/1997
JP 09-244575 9/1997
JP 2000322025 A * 11/2000
JP 2002-132213 5/2002
JP 2003-337568 11/2003

OTHER PUBLICATIONS

Japanese Search Report dated Aug. 22, 2007.
Annex to European Search Report dated Jun. 21, 2004.

* cited by examiner

*Primary Examiner*—Amr Awad
*Assistant Examiner*—Alexander S. Beck
(74) *Attorney, Agent, or Firm*—KED & Associates, LLP

(57) ABSTRACT

A method and apparatus for driving a plasma display panel that is adaptive for improving a sustain driving margin. In the method and apparatus, the number of sustaining pulses is set in response to an average picture level. A period of the sustaining pulse is set in proportion to said average picture level.

19 Claims, 13 Drawing Sheets

METHOD AND APPARATUS FOR DRIVING PLASMA DISPLAY PANEL

BACKGROUND OF THE INVENTION

1. Field of the Invention

This invention relates to a plasma display panel, and more particularly to a method and apparatus for driving a plasma display panel that is adaptive for improving a sustain driving margin.

2. Description of the Related Art

Generally, a plasma display panel (PDP) is a display device utilizing a visible light emitted from a phosphorus material when a vacuum ultraviolet ray generated by a gas discharge excites the phosphorus material. The PDP has an advantage in that it has a thinner thickness and a lighter weight in comparison to the existent cathode ray tube (CRT) and is capable of realizing a high resolution and a large-scale screen. The PDP consists of a plurality of discharge cells arranged in a matrix type, each of which makes one picture element or pixel of the screen.

FIG. 1 is a perspective view showing a discharge cell structure of a conventional three-electrode, AC surface-discharge PDP.

Referring to FIG. 1, a discharge cell of the conventional three-electrode, AC surface-discharge PDP includes a first electrode 12Y and a second electrode 12Z provided on an upper substrate 10, and an address electrode 20X provided on a lower substrate 18.

On the upper substrate 10 provided with the first electrode 12Y and the second electrode 12Z in parallel, an upper dielectric layer 14 and a protective film 16 are disposed. Wall charges generated upon plasma discharge are accumulated into the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO).

A lower dielectric layer 22 and barrier ribs 24 are formed on the lower substrate 18 provided with the address electrode 20X. The surfaces of the lower dielectric layer 22 and the barrier ribs 24 are coated with a phosphorous material layer 26. The address electrode 20X is formed in a direction crossing the first electrode 12Y and the second electrode 12Z.

The barrier rib 24 is formed in parallel to the address electrode 20X to prevent an ultraviolet ray and a visible light generated by a discharge from being leaked to the adjacent discharge cells. The phosphorous material layer 26 is excited by an ultraviolet ray generated during the plasma discharge to generate any one of red, green and blue visible light rays. An inactive gas for a gas discharge is injected into a discharge space defined between the upper and lower substrate 10 and 18 and the barrier rib 24.

Such a PDP drives one frame, which is divided into various sub-fields having a different discharge frequency, so as to express gray levels of a picture. Each sub-field is again divided into a reset period for uniformly causing a discharge, an address period for selecting the discharge cell and a sustain period for realizing the gray levels depending on the discharge frequency. For instance, when it is intended to display a picture of 256 gray levels, a frame interval equal to 1/60 second (i.e. 16.67 msec) is divided into 8 sub-fields SF1 to SF8 as shown in FIG. 2. Each of the 8 sub-fields SF1 to SF8 is divided into an address period and a sustain period. Herein, the reset period and the address period of each sub-field are equal every sub-field, whereas the sustain period are increased at a ratio of $2^n$ (wherein n=0, 1, 2, 3, 4, 5, 6 and 7) at each sub-field, to thereby display a picture according to the gray levels.

Referring to FIG. 3, a conventional driving apparatus for the PDP includes a first inverse gamma corrector 32A, a gain controller 34, an error diffuser 36, a sub-field mapping unit 38 and a data aligner 40 that are connected between an input line 1 and a panel 46, and a frame memory 30, a second inverse gamma corrector 32B, an average picture level (APL) unit 42 and a waveform generator 44 that are connected between the input line 1 and the panel 46.

The first and second inverse gamma adjusters 32A and 32B makes an inverse gamma correction of a gamma-corrected video signal to thereby linearly convert a brightness value according to a gray level value of the video signal. The frame memory 30 stores data R,G and B for one frame and applies the stored data to the second inverse gamma corrector 32B.

The APL unit 42 receives a video data corrected by the second inverse gamma corrector 32B to generate N step signals (wherein N is an integer) for controlling the number of sustaining pulses. The gain controller 34 amplifies a video data corrected by the first inverse gamma corrector 32A by an effective gain.

The error diffuser 36 diffuses an error component of the cell into adjacent cells to make a fine adjustment of a brightness value. The sub-field mapping unit 38 re-assigns the corrected video data from the error diffuser 36 for each sub-field.

The data aligner 40 converts the video data inputted from the sub-field mapping unit 38 in such a manner to be suitable for making a resolution format of the panel 46, and applies it to an address driving integrated circuit (IC) of the panel 46.

The waveform generator 44 generates a timing control signal using the N-step signal inputted from the APL unit 42, and applies the generated timing control signal to the address driving IC, a scan driving IC and a sustain driving IC of the panel 46.

In such a conventional PDP driving apparatus, the APL unit 42 keeps a power consumption of the PDP constantly and emphasizes a relatively bright area when a brightness of the entire image is low. To this end, the APL is set to be in inverse proportion to the number of sustaining pulses as shown in FIG. 4. In other words, a small number of sustaining pulses are applied when the APL is high, whereas a large number of sustaining pulses are applied when the APL is low. If the APL is set to be in inverse proportion to the number of sustaining pulses, then a power consumption of the panel is kept substantially constantly and a relatively bright area is emphasized when a brightness of the entire image is low.

However, when the APL is set to be in inverse proportion to the number of sustaining pulses, a small number of sustaining pulses are applied at a high APL to thereby cause a problem in that a sustain period fails to be sufficiently utilized. In other words, because a sustaining pulse is applied only in a portion of the sustain period at the high APL, a sustain driving margin is deteriorated. Therefore, in the conventional PDP, emission efficiency at the high APL is lowered in comparison to other cases.

More specifically, since a small number of sustaining pulse is applied at a high APL, the sustaining pulse is applied only at a portion of a predetermined sustain period. Thus, a time interval at which any discharge is not generated (hereinafter referred to as "idle interval"), of the sustain period, is widened at the high APL. If an idle interval is widened, that is, if a time supplied with a sustaining pulse between the current sustain period and the next sustain period is set to be long, then a sustain driving margin is deteriorated. For instance, if the idle interval is widened, then electrical charge particles generated by the previous sustain discharge are wasted due to a re-binding thereof, thereby causing an unstable sustain discharge.

SUMMARY OF THE INVENTION

Accordingly, it is an object of the present invention to provide a method and apparatus for driving plasma display panel that is adaptive for improving a sustain driving margin.

In order to achieve these and other objects of the invention, a method of driving a plasma display panel according to one aspect of the present invention includes the steps of setting the number of sustaining pulses in response to an average picture level; and setting a period of the sustaining pulse in proportion to said average picture level.

In the method, said step of setting the number of sustaining pulses includes setting the number of sustaining pulses in inverse proportion to an average picture level.

Said step of setting a period of sustaining pulses includes setting a high width of the sustaining pulse largely in proportion to an average picture level.

Said step of setting a period of sustaining pulses includes setting a low width of the sustaining pulse largely in proportion to an average picture level.

Said step of setting a period of sustaining pulses includes setting a low width and a high width of the sustaining pulse largely in proportion to an average picture level.

Herein, a maximum period of the sustaining pulse is wider, by 0.5 μs to 10 μs, than a minimum period of the sustaining pulse.

Said period of the sustaining pulse is changed in at least partial region of said average picture level.

The method further includes the step of setting a minimum limit frequency at more than a desired average picture level such that said period of the sustaining pulse is limited to less than a certain width.

Herein, said minimum limit frequency is set such that a maximum period of the sustaining pulse is widened, by 0.5 μs to 10 μs, than a minimum period of the sustaining pulse.

The method further includes the step of setting a maximum limit frequency at less than a desired average picture level such that said period of the sustaining pulse is limited to more than a certain width.

Said period of the sustaining pulse is increased in a stepwise manner as said average picture level goes from a lower level into a higher level.

A method of driving a plasma display panel according to another aspect of the present invention includes the steps of setting the number of sustaining pulses in response to an average picture level; and setting a high width of the sustaining pulse in proportion to said average picture level.

Said high width of the sustaining pulse is changed in at least partial region of said average picture level.

A method of driving a plasma display panel according to still another aspect of the present invention includes the steps of setting the number of sustaining pulses in response to an average picture level; and setting a low width of the sustaining pulse in proportion to said average picture level.

Said low width of the sustaining pulse is changed in at least partial region of said average picture level.

A driving apparatus for a plasma display panel according to still another aspect of the present invention includes average picture level means for setting an average picture level corresponding to a video data; and period setting means for setting a period of a sustaining pulse in such a manner to be in proportion to said average picture level set by the average picture level means.

In the driving apparatus, said period setting means sets a high width of the sustaining pulse in proportion to said average picture level.

Said period setting means sets a low width of the sustaining pulse in proportion to said average picture level.

Alternatively, said period setting means sets a low width and a high width of the sustaining pulse in proportion to said average picture level.

The driving apparatus further includes limit value setting means for setting at least one of a maximum limit value capable of widening a period of the sustaining pulse and a minimum limit value capable of narrowing said period of the sustaining pulse.

Herein, said period setting means receives at least one of said maximum limit value and said minimum limit value to control said period of the sustaining pulse.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 5A:
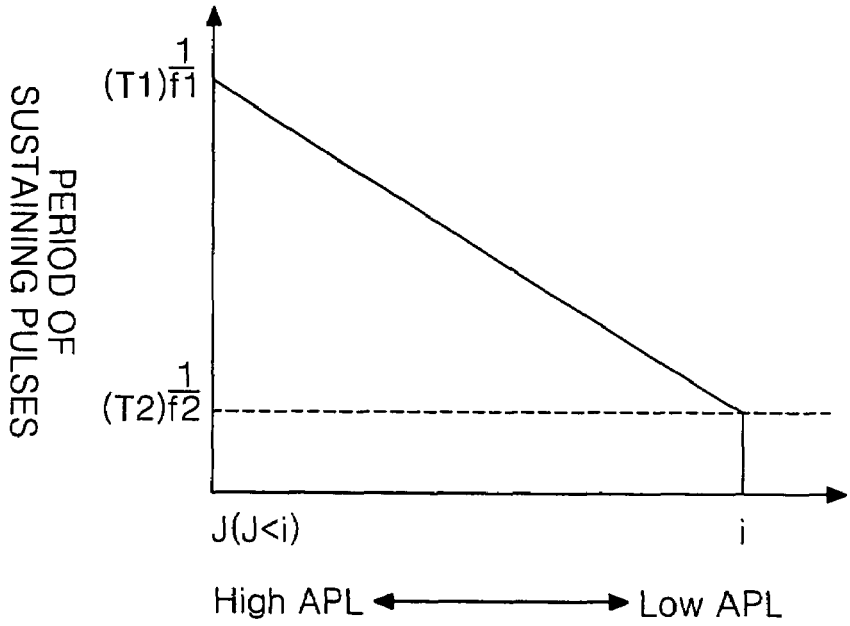
FIG. 5A and FIG. 5B are graphs representing a frequency of the sustaining pulse according to the APL in a first embodiment of the present invention.
Figure 5B:
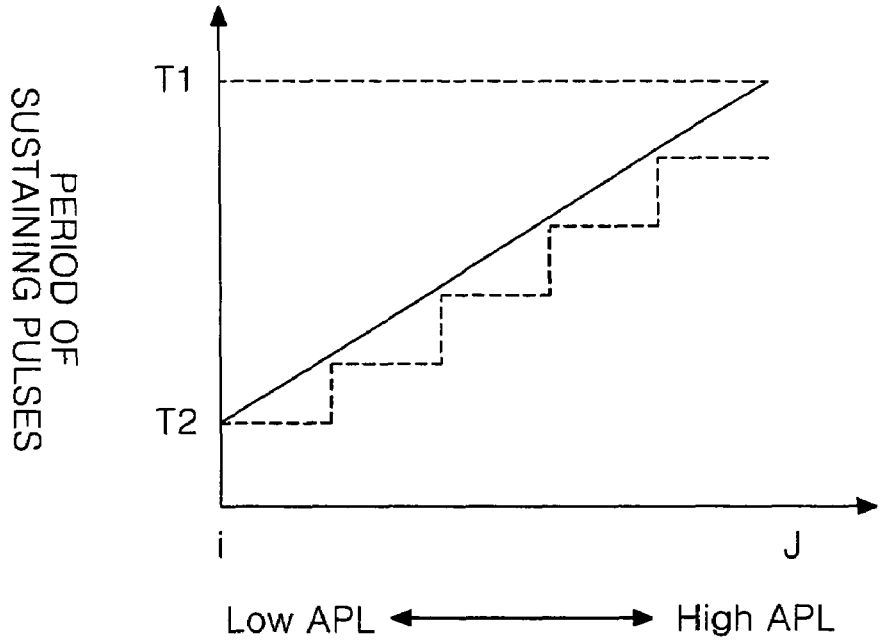

FIG. 5A and FIG. 5B are graphs representing a frequency of a sustaining pulse according to an APL in a first embodiment of the present invention.

Figure 1:
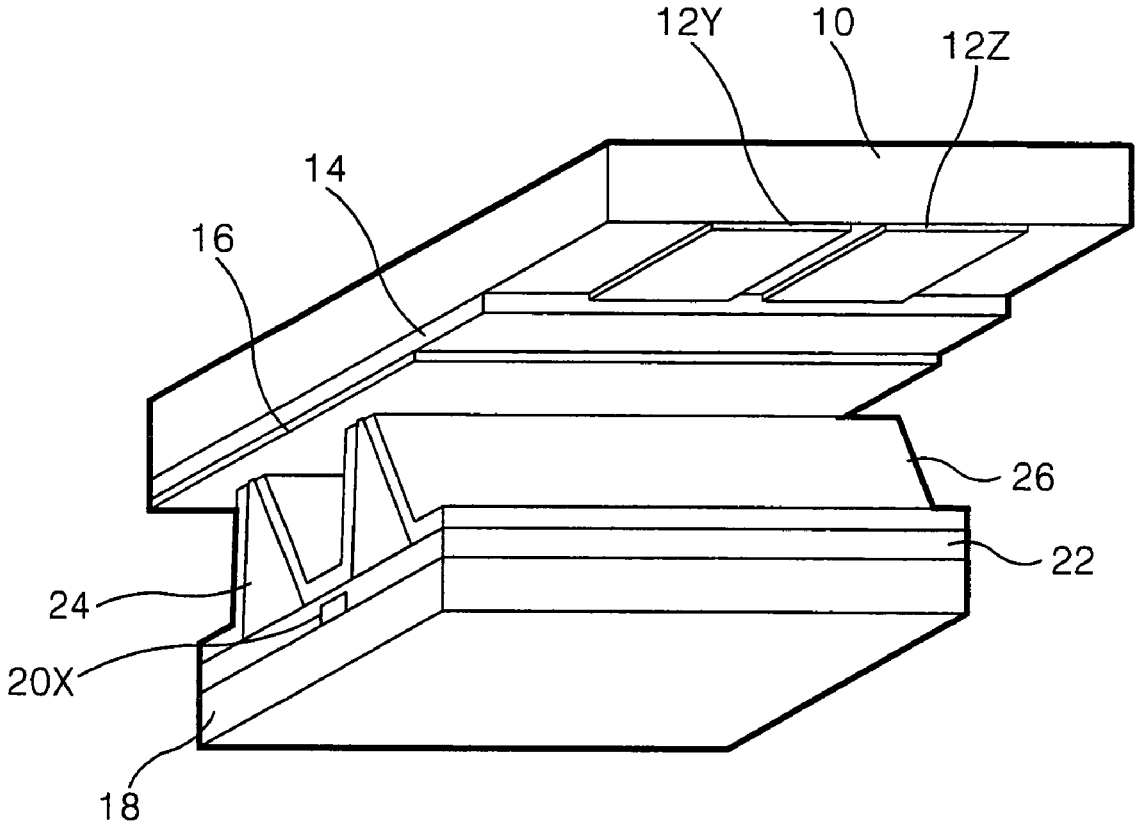
FIG. 1 RELATED ART
FIG. 1 is a perspective view showing a discharge cell structure of a conventional three-electrode, AC surface-discharge plasma display panel.
Figure 2:
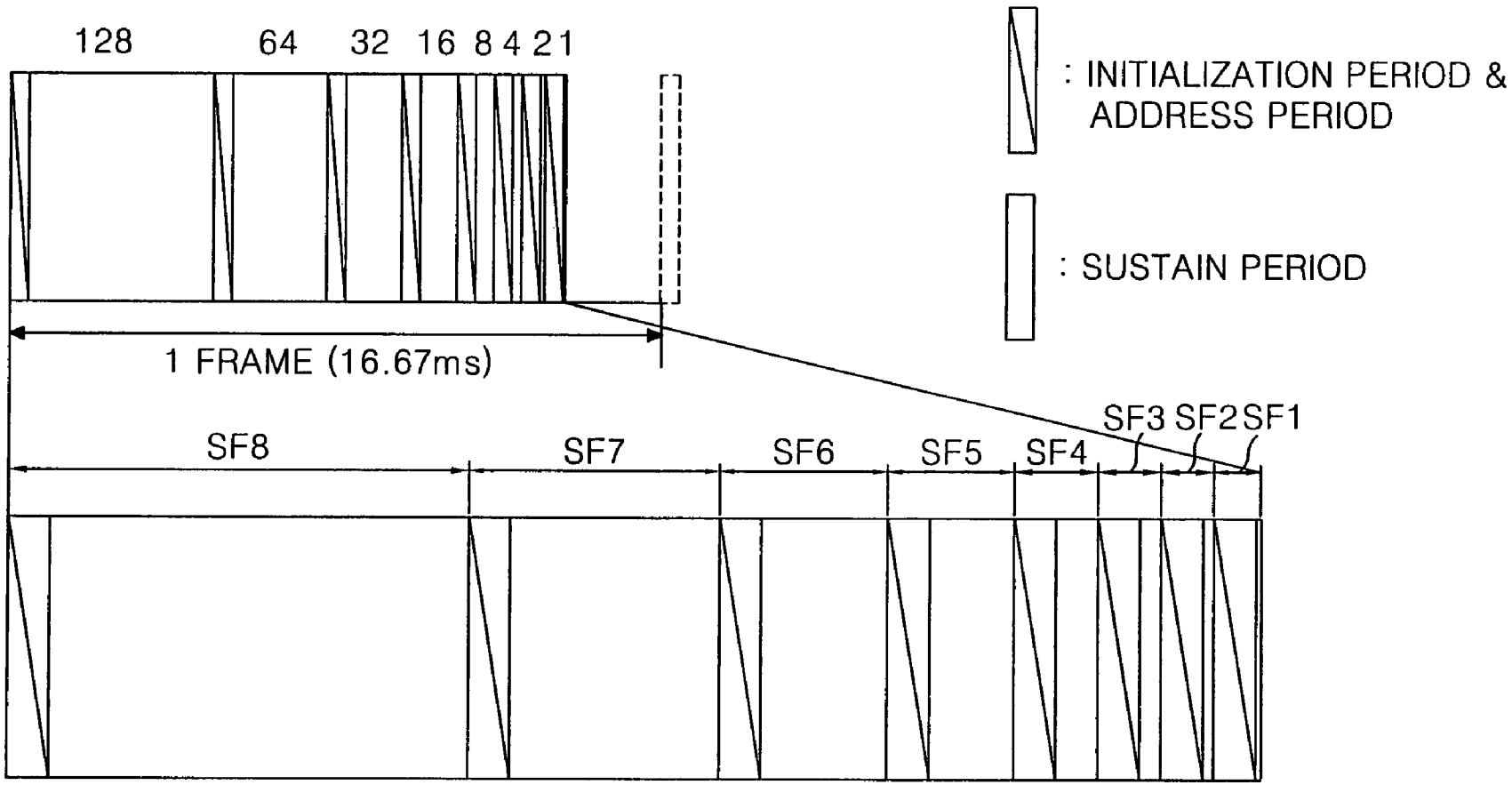
FIG. 2 RELATED ART
FIG. 2 depicts one frame of the conventional three-electrode, AC surface-discharge plasma display panel.
Figure 3:
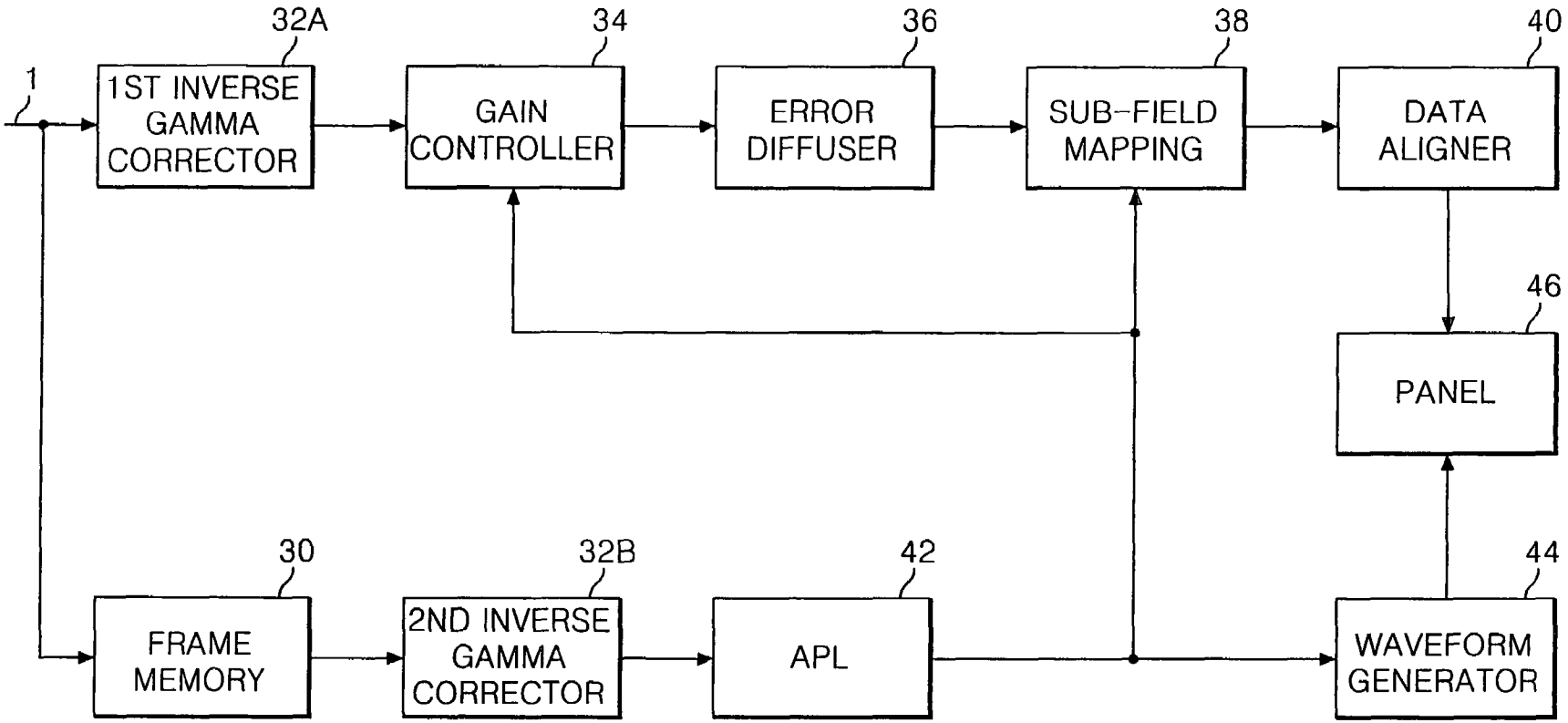
FIG. 3 RELATED ART
FIG. 3 is a block diagram showing a configuration of a conventional plasma display panel driving apparatus.
Figure 4:
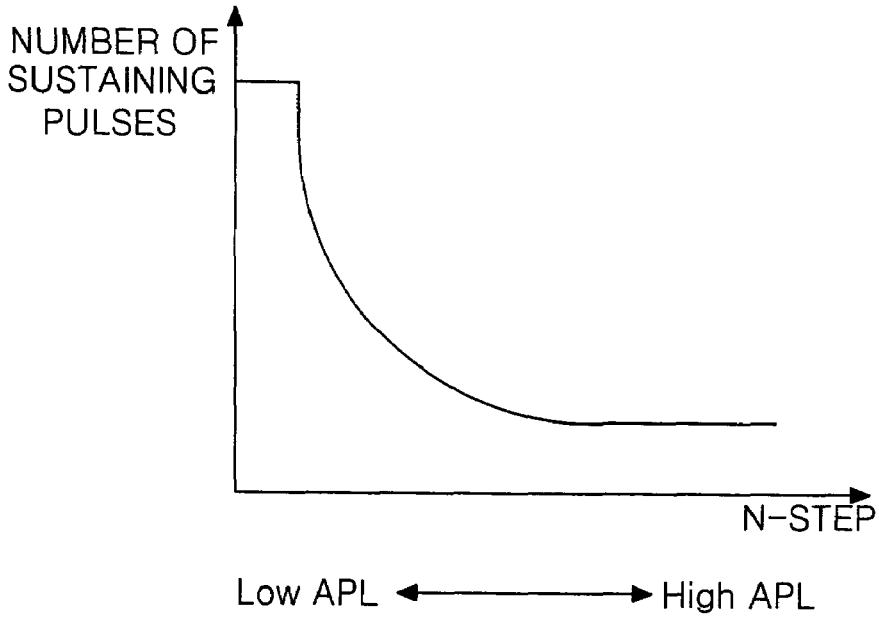
FIG. 4 RELATED ART
FIG. 4 is a graph representing the number of sustaining pulses set in correspondence with the APL.

As shown in FIG. 4, the APL has a relationship being in inverse proportion to the number of sustaining pulses. In other words, a small number of sustaining pulses are applied to the panel when the APL becomes higher, whereas a large number of sustaining pulses are applied to the panel when the APL becomes lower. At this time, in the first embodiment of the present invention, as it goes from a lower APL into a higher APL as shown in FIG. 5, a period of the sustaining pulse is set to be linearly increased (i.e., a frequency of the sustaining pulse is set to be linearly decreased. Herein, the number of sustaining pulses applied really is set to be the same as that in the prior art.

More specifically, at a low APL, i (e.g., 1024) sustaining pulses are applied to the panel. In this case, a period T2 of the sustaining pulse having a relationship being in inverse proportion to a frequency f2 has a narrow width (e.g., 5 μs). In other words, at a low APL, i sustaining pulses are applied to the panel in such a manner to have a period T2.

On the other hand, at a high APL, j (e.g., 200) sustaining pulses are applied to the panel. In this case, a frequency of the sustaining pulse applied at the high APL is set to have a small value (f1>f2). Thus, a period T1 of the sustaining pulse having a relationship being in inverse proportion to the frequency f1 has a wide width (e.g., 20 μs). In other words, at the high APL, j sustaining pulses are applied to the panel in such a manner to have a period T1.

In other words, in the first embodiment of the present invention, a period of the sustaining pulse is increased in such a manner to be in proportion to the APL. If a period of the sustaining pulse is increased in such a manner to be in proportion to the APL, then an idle interval is not widened even at a high APL to enhance a sustain driving margin.

A period increasing rate of the sustaining pulse proportional to the APL is determined experimentally. In real, a period of the sustaining pulse increased in proportion to the APL is variously set by a resolution and a length, etc. of the PDP. For instance, if a sustaining pulse having a period of 5 μs is applied at the minimum APL, then a sustaining pulse having a period of 5.5 μs to 15 μs can be applied at the maximum APL. In other words, if a period of the sustaining pulse is increased from the minimum APL into the maximum APL in the first embodiment, then it can be increased by about 0.7 μs to 10 μs.

Furthermore, in the first embodiment, the APL is divided into a plurality of region units, and a period of the sustaining pulse can be increased in response to these region units. In other words, in the first embodiment, the APL is divided into a plurality of regions as seen from a dotted line in FIG. 5B, and a sustaining pulse having the same period can be applied at an APL included in the same region while a sustaining pulse having a different period can be applied at the APL included in a different region. Herein, as an APL included in the region is higher, a period of the sustaining pulse is more increased.

Figure 6A:
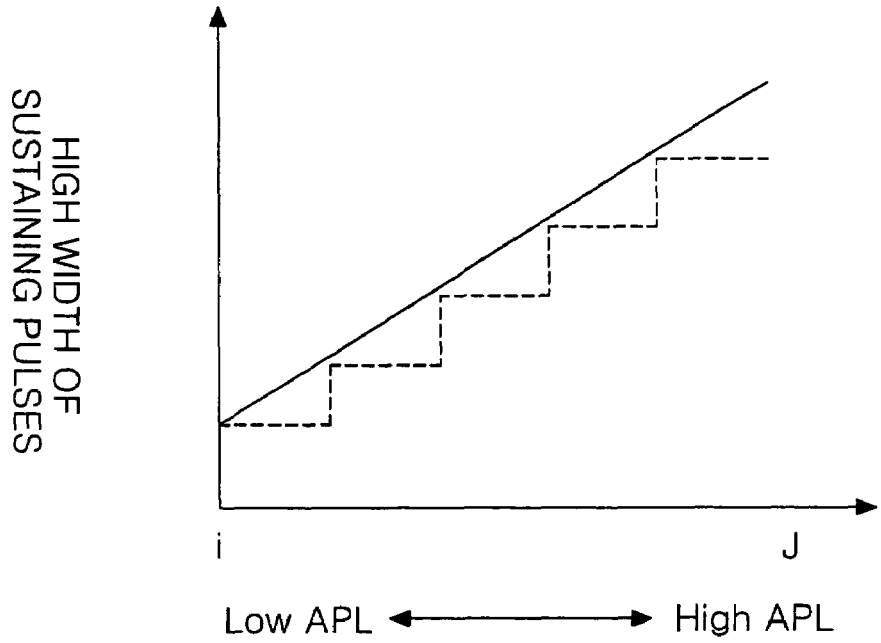
FIG. 6A and FIG. 6B are graphs showing that, as a period of the sustaining pulse is wider, a high width of the sustaining pulse is enlarged in proportion to an APL.
Figure 6B:
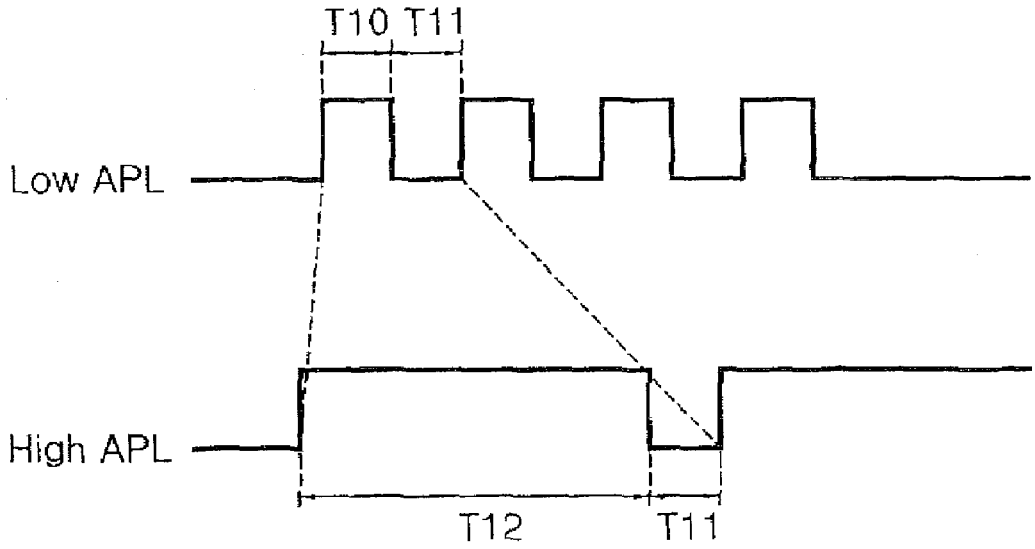

Meanwhile, in the first embodiment, various strategies may be used for the purpose of establishing a period of the sustaining pulse widely. For instance, as shown in FIG. 6A and FIG. 6B, a high width T10 of the sustaining pulse only can be increased a high width T12 to set a period of the sustaining pulse widely. The low width T11 of the sustaining pulse is maintained.

More specifically, as shown in FIG. 6A and FIG. 6B, as it goes from a lower APL into a higher APL, a high width T10 of the sustaining pulse is increased to the width T12 to set a period of the sustaining pulse widely. If a high width of the sustaining pulse is widened, then it becomes possible to cause a stable sustain discharge. In other words, if a high width of the sustaining pulse is widened, then a time capable of generating a sustain discharge is widened so that a probability capable of causing the sustaining discharge is increased.

Alternatively, in the first embodiment, the APL is divided into a plurality of regions as seen from a dotted line in FIG. 6A, and a sustaining pulse having the same high width is applied in the APL included in the same region while a sustaining pulse having a different period can be applied at the APL included in a different region.

Figure 7A:
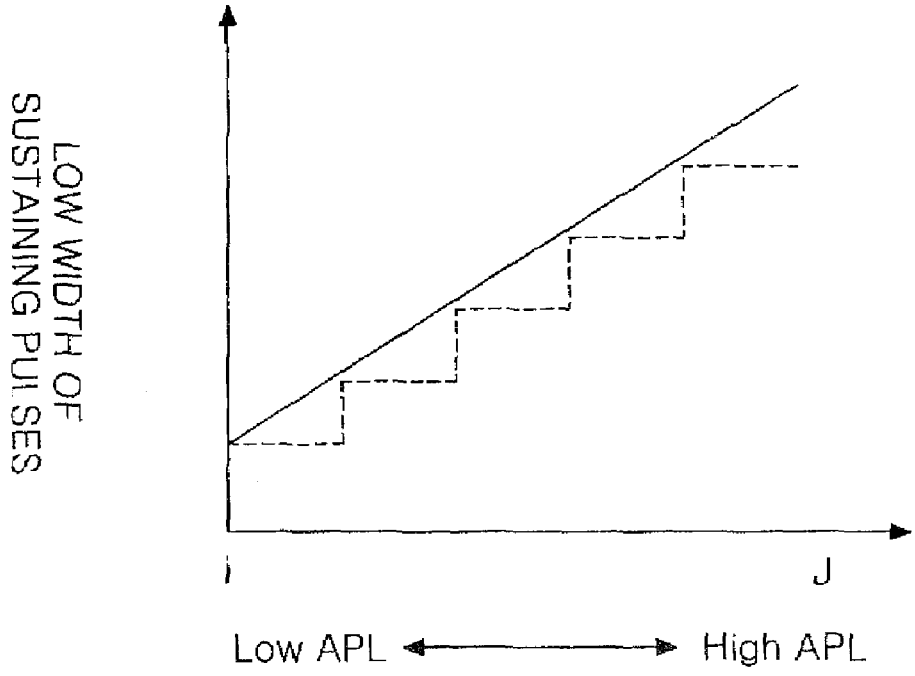
FIG. 7A and FIG. 7B are graphs showing that, as a period of the sustaining pulse is wider, a low width of the sustaining pulse is enlarged in proportion to an APL.
Figure 7B:
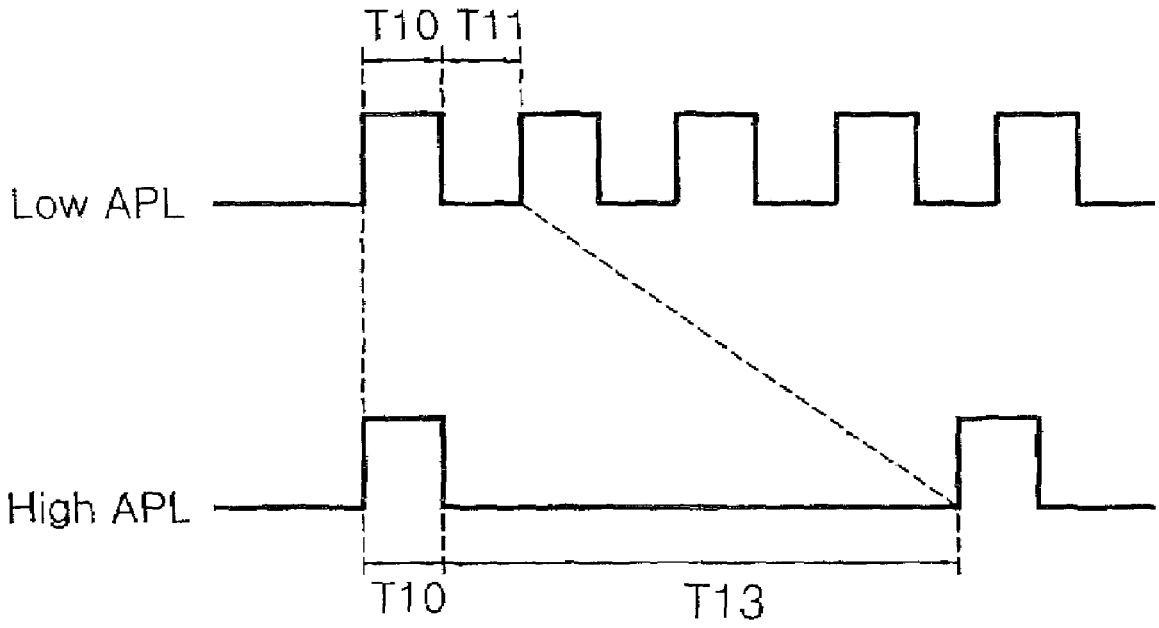

Otherwise, in the first embodiment, a low width of the sustaining pulse only may be increased as shown in FIG. 7A and FIG. 7B for the purpose of setting a period of the sustaining pulse widely. More specifically, as shown in FIG. 7A and FIG. 7B, as it goes from a lower APL into a higher APL, a low width T11 of the sustaining pulse can be more increased to a low width T13 to set a period of the sustaining pulse widely. The high width T10 of be the sustaining pulse is maintained. If a low width of the sustaining pulse is enlarged in proportion to the APL, it becomes possible to prevent an idle interval from being increased in a high APL, thereby causing a stable sustain discharge. In other words, if a low width of the sustaining pulse is enlarged in proportion to the APL, then an idle interval at which any sustaining pulse is not applied can be almost constantly kept irrespectively of the APL. If the idle interval is not widened in response to a high APL, then it becomes possible to cause a stable sustain discharge.

On the other hand, in the first embodiment, the APL is divided into a plurality of regions as seen from a dotted line in FIG. 7A, and a low width of the sustaining pulse can be enlarged. More specifically, in the first embodiment, the APL is divided into a plurality of regions like a dotted line in FIG. 7A, and a sustaining pulse having the same low width is applied in the APL included in the same region while a sustaining pulse having a different low width can be applied at the APL included in a different region. Alternatively, in the first embodiment, as it goes from a lower APL into a higher APL, a low width and a high width of the sustaining pulse may be enlarged to thereby set a period of the sustaining pulse widely.

Figure 8A:
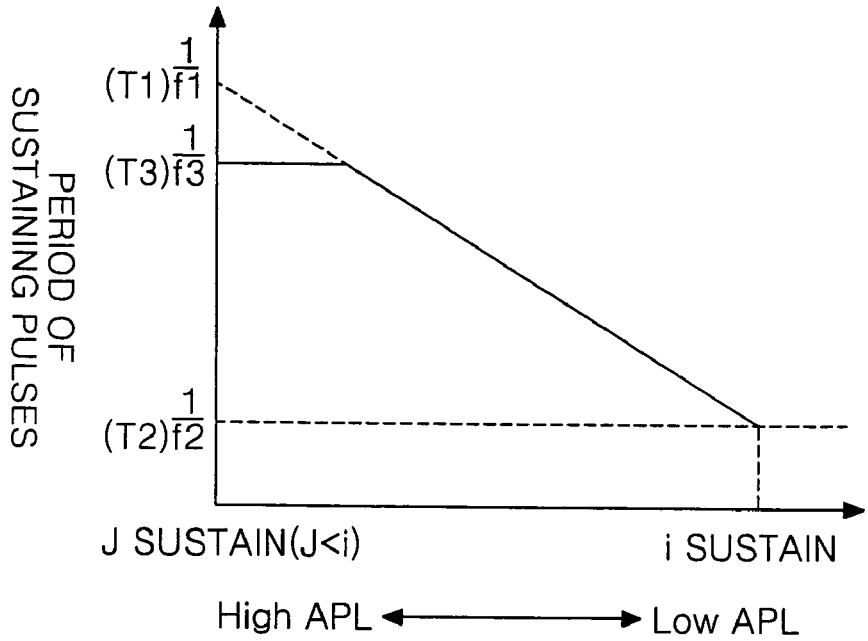
FIG. 8A and FIG. 8B are graphs representing a frequency of the sustaining pulse according to the APL in a second embodiment of the present invention.
Figure 8B:
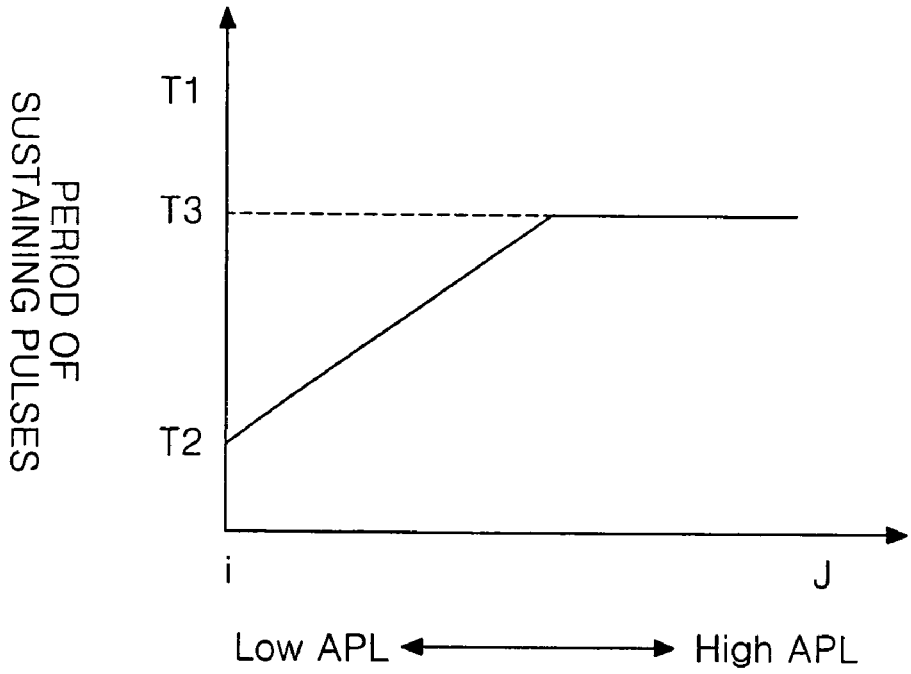

FIG. 8A and FIG. 8B are graphs representing a period of the sustaining pulse according to an APL in the second embodiment of the present invention.

Referring to FIG. 8A and FIG. 8B, in the second embodiment of the present invention, as it goes from a lower APL into a higher APL, a period of the sustaining pulse is linearly increased (i.e., a frequency of the sustaining pulse is linearly decreased). Further, in the second embodiment of the present invention, a minimum limit frequency f3 (i.e., a maximum sustaining pulse period T3) is set, and a sustaining pulse having the minimum limit frequency f3 is applied to the panel when the APL is increased to more than a predetermined value.

More specifically, in the second embodiment, a period of the sustaining pulse is set to be in proportion to the APL.

In other words, when the APL is increased, a period of the sustaining pulse also is increased to thereby sufficiently utilize the sustain period even at a high APL.

Furthermore, in the second embodiment, a minimum limit frequency f3 is set such that a period of the sustaining pulse can be kept constantly when an APL becomes more than a specific level. For instance, if a minimum limit frequency f3 is set such that the sustaining pulse has a period of 15 μs, then a sustaining pulse having a period of 15 μs is applied at an APL more than the specific level. In other words, at an APL more than the specific level, the number of sustaining pulses only is changed (as an APL goes higher, the number of sustaining pulses is reduced as shown in FIG. 4), whereas a period (or frequency) of the sustaining pulse is kept constantly. Herein, the minimum limit frequency f3 is set, in advance, by a designer such that a sufficient sustain margin can be assured at a high APL. In other words, the minimum limit frequency f3 is experimentally set such that the panel can assure a sufficient sustain margin in correspondence with a length (i.e., inch) and a resolution, etc. In real, the minimum limit frequency f3 can be variously set in consideration of a resolution and a length (i.e., inch), etc. of the PDP such that the PDP can make a stable operation. For instance, if a sustaining pulse having a period of 5 μs is applied at the minimum APL, then the minimum limit frequency f3 can be set such that a maximum period of the sustaining pulse becomes about 5.5 μs to 15 μs. In other words, in the second embodiment, the limit frequency f3 is set such that a period of the sustaining pulse is increased, by about 0.5 μs to 10 μs, from a period of the sustaining pulse applied at the minimum APL.

In the second embodiment of the present invention, a period of the sustaining pulse is linearly increased in proportion to the APL, so that it becomes possible to prevent an idle interval from being enlarged at a high APL and hence enhance a sustain driving margin. Furthermore, the minimum limit frequency f3 is set such that all the sustaining pulses can be applied within a predetermined sustain period, thereby causing a stable sustain discharge.

Figure 9A:
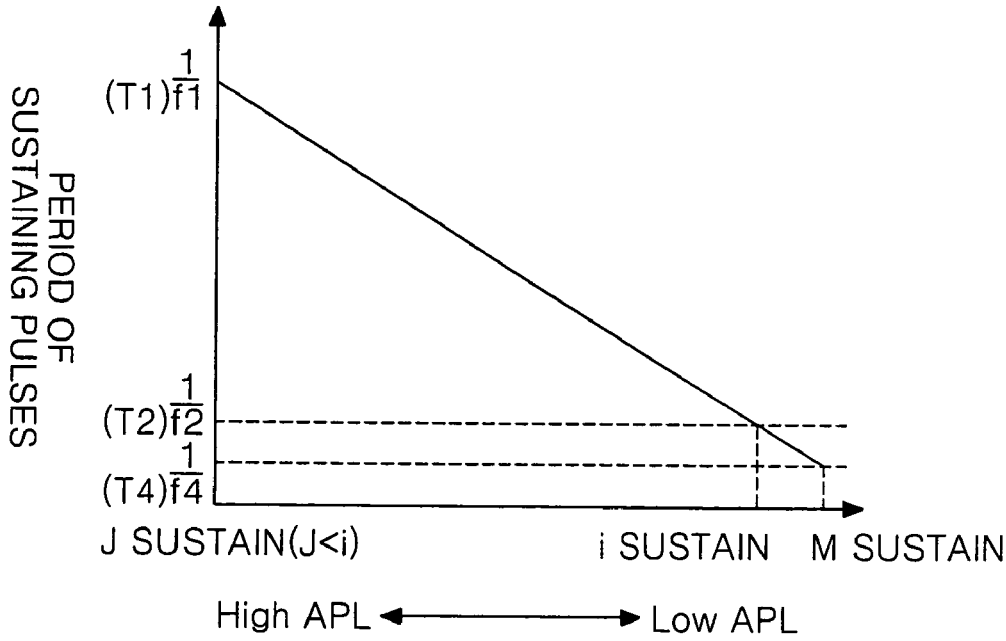
FIG. 9A and FIG. 9B are graphs representing a period of the sustaining pulse according to the APL in a third embodiment of the present invention.
Figure 9B:
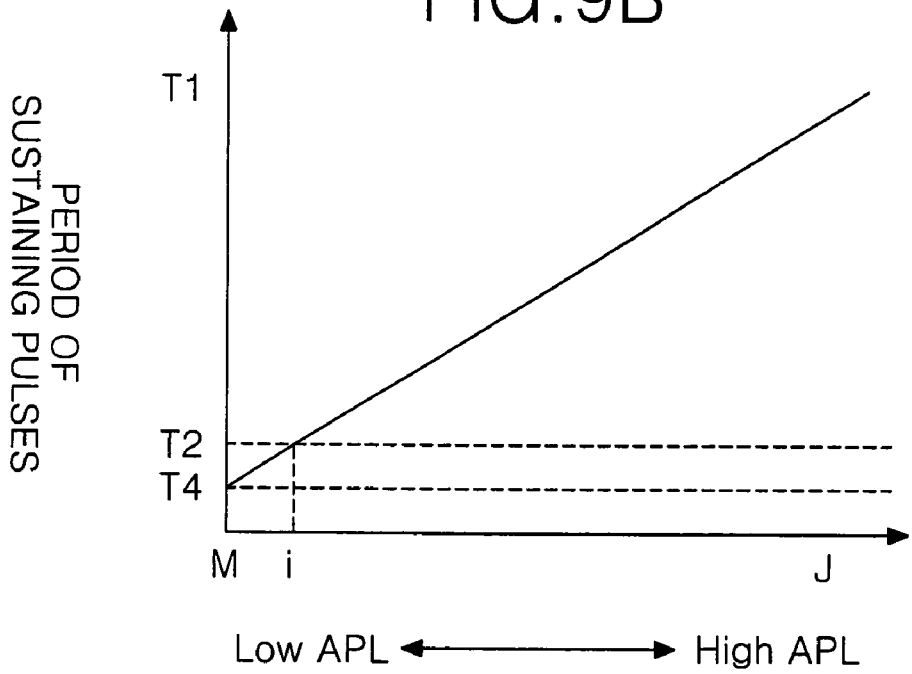

FIG. 9A and FIG. 9B are graphs representing a period of the sustaining pulse according to an APL in the third embodiment of the present invention.

Referring to FIG. 9A and 9B, in the third embodiment of the present invention, as it goes from a lower APL into a higher APL, a period of the sustaining pulse is linearly increased (i.e., a frequency of the sustaining pulse is linearly decreased). Further, in the third embodiment of the present invention, a maximum limit frequency f4 (i.e., a minimum sustaining pulse period T4) is set so that the number of sustaining pulses applied to the panel at a low APL can be set optionally.

In other words, in the third embodiment, a maximum limit frequency f4 is set to a specific level of the APL such that the number of sustaining pulse capable of being applied to the panel at the lowest APL can be set optionally. For instance, a maximum limit frequency can be set such that j (e.g., 1500) sustaining pulses having a larger value than i (e.g., 1024) are applied to the panel at the lowest APL (f4>f2). In this case, since a period of the sustaining pulse is in inverse proportion to the maximum limit frequency f4, it has a narrow width T4 (e.g., 3 μs. If the maximum limit frequency f4 is set highly to apply a large number of sustaining pulses to the panel as mentioned above, then it becomes possible to improve a peak brightness of the panel.

On the other hand, at a high APL, j (e.g., 200) sustaining pulses are applied to the panel. In this case, a frequency f1 of the sustaining pulse applied at a high APL is set to have a low value. Thus, a period T1 of the sustaining pulse having a relationship being in inverse proportion to the frequency f1 has a wide value (e.g., 20 μs). In other words, j sustaining pulses are applied to the panel in such a manner to have a period T1 at a high APL.

As described above, in the third embodiment, a period of the sustaining pulse is linearly increased in proportion to the APL, thereby improving an emission efficiency. Furthermore, the third embodiment of the present invention set a maximum limit frequency f4 to apply a large number of sustaining pulses at a low APL, thereby improving a peak brightness of the panel.

Figure 10A:
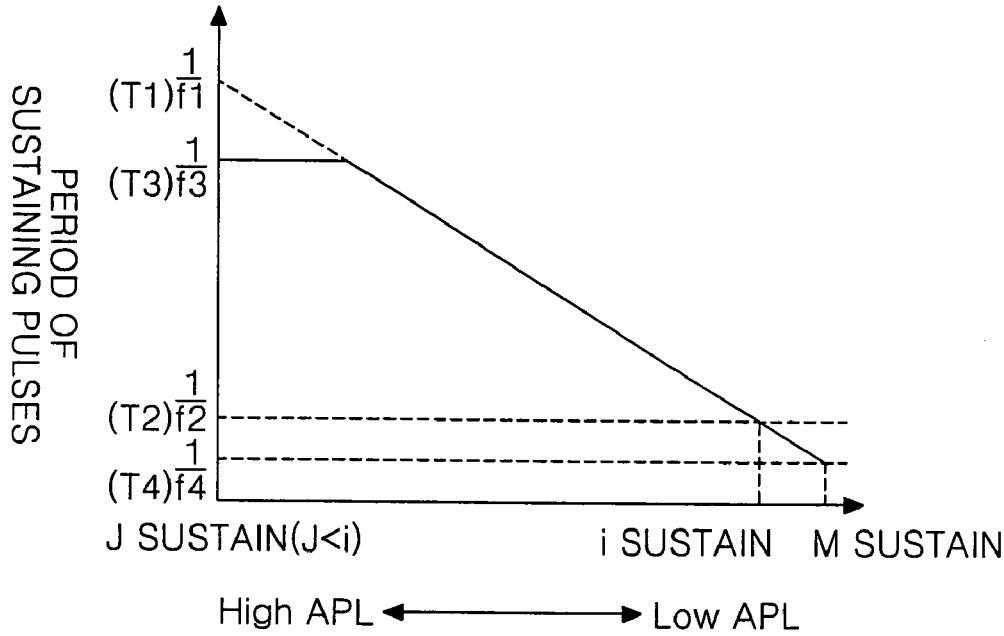
FIG. 10A and FIG. 10B are graphs representing a frequency of the sustaining pulse according to the APL in a fourth embodiment of the present invention.
Figure 10B:
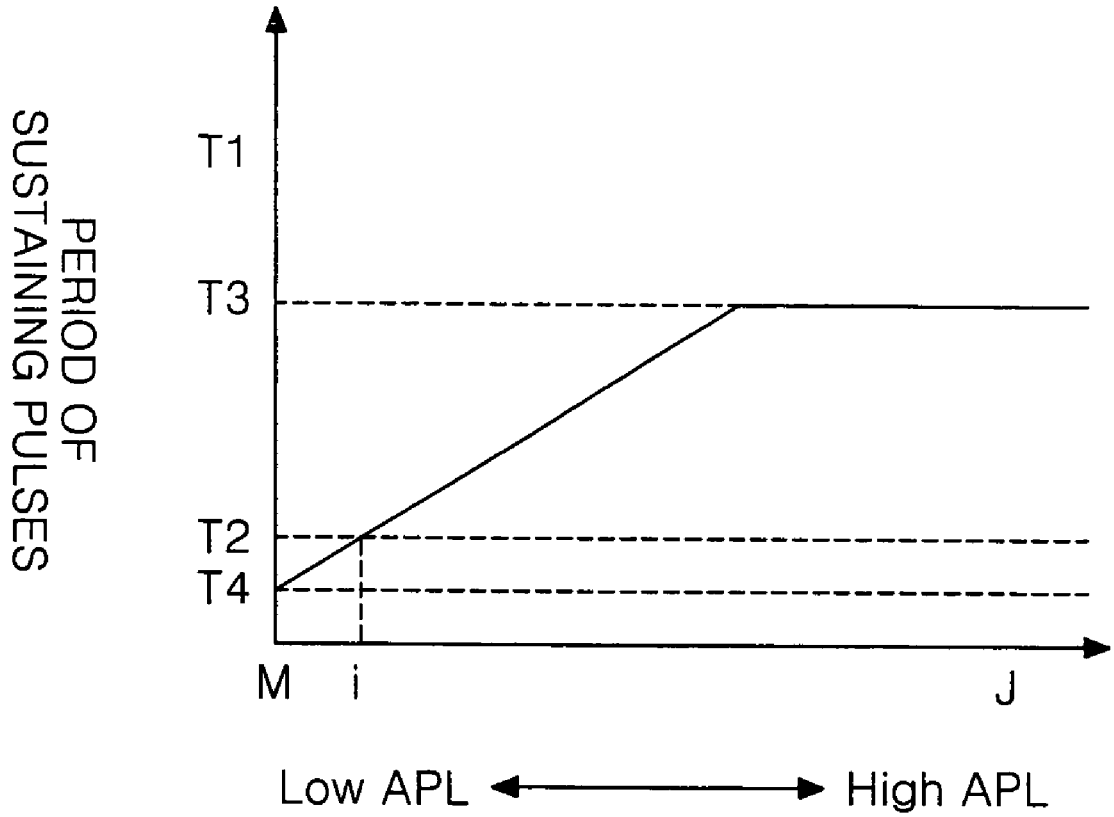

Alternatively, in the embodiment of the present invention, the maximum limit frequency f4 and the minimum limit frequency f3 may be set at the same time as shown FIG. 10A and FIG. 10B. The maximum frequency f4 and the minimum frequency f3 are set at the same time as shown in FIG. 8, so that it becomes possible to improve a peak brightness of the panel and cause a stable sustain discharge.

Figure 11:
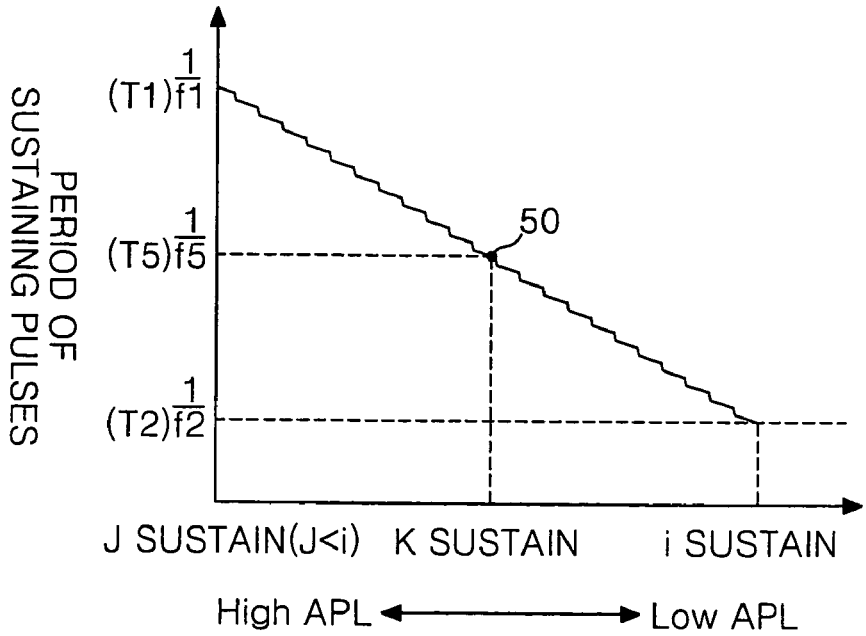
FIG. 11 is a graph representing a frequency of the sustaining pulse according to the APL in a fifth embodiment of the present invention.

Meanwhile, in the embodiments of the present invention shown in FIG. 5A, FIG. 6A, FIG. 7A, FIG. 8A, FIG. 9A and FIG. 10A, a frequency (or period) has been linearly increased or decreased in accordance with the APL. But, when the present invention is really applied to the PDP, a frequency (or period) is increased or decreased in a stepwise manner in correspondence with the APL as shown in FIG. 11. More specifically, if a frequency is linearly increased or decreased in accordance with the APL, K sustaining pulses having a frequency f5 (f2>f5>f1) should be applied at a specific level 50 of the APL. Herein, if the APL is linearly increased or decreased, then the frequency f5 (or period) may be set to a real number having a decimal point. However, since a frequency including a decimal point can not be applied, the frequency f5 is set to an integer by the descending method. In other words, since a frequency is set by the descending method when the present invention is really implemented, a frequency (or period) is increased or decreased in a stepwise manner in correspondence with the APL.

Figure 12:
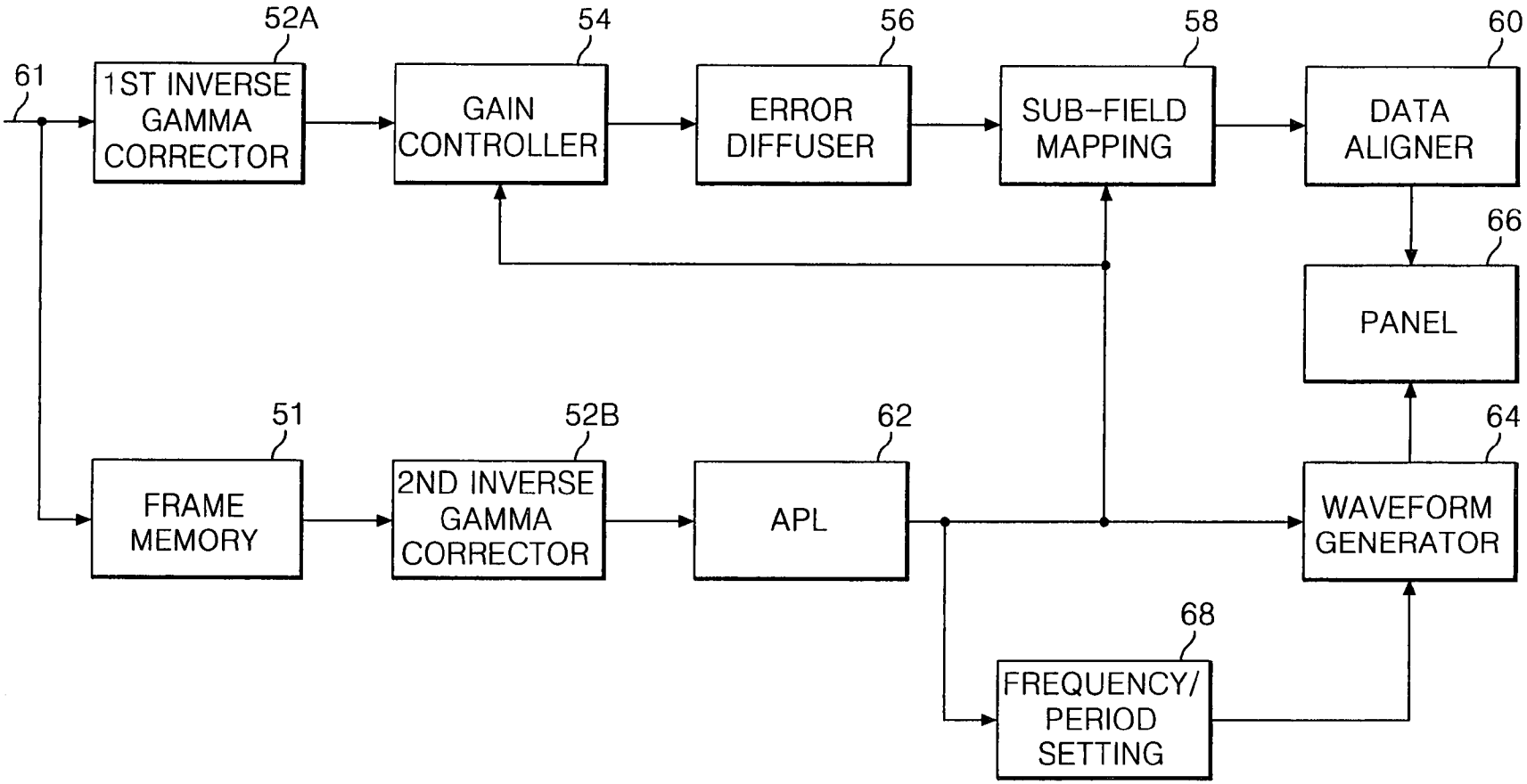
FIG. 12 is a block diagram showing a configuration of a plasma display panel driving apparatus according to one embodiment of the present invention.

FIG. 12 shows a PDP driving apparatus according to one embodiment of the present invention.

Referring to FIG. 12, the PDP driving apparatus includes a first inverse gamma corrector 52A, a gain controller 54, an error diffuser 56, a sub-field mapping unit 58 and a data aligner 60 that are connected between an input line 61 and a panel 66, and a frame memory 51, a second inverse gamma corrector 52B, an average picture level (APL) unit 62, a frequency/period setting unit 68 and a waveform generator 64 that are connected between the input line 61 and the panel 66.

The first and second inverse gamma correctors 52A and 52B makes an inverse gamma correction of a gamma-corrected video signal to thereby linearly convert a brightness value according to a gray level value of the video signal. The frame memory 51 stores data R,G and B for one frame and applies the stored data to the second inverse gamma corrector 52B.

The APL unit 62 receives a video data corrected by the second inverse gamma corrector 52B to generate N-step signals (wherein N is an integer) for controlling the number of sustaining pulses. The gain controller 54 amplifies a video data corrected by the first inverse gamma corrector 52A by an effective gain.

The error diffuser 56 diffuses an error component of the cell into adjacent cells to make a fine adjustment of a brightness value. The sub-field mapping unit 58 re-assigns the corrected video data from the error diffuser 56 for each sub-field.

The data aligner 60 converts the video data inputted from the sub-field mapping unit 58 in such a manner to be suitable for making a resolution format of the panel 66, and applies it to an address driving integrated circuit (IC) of the panel 66.

The frequency/period setting unit 68 determines a frequency/period of a sustaining pulse in correspondence with the APL applied from the APL unit 62. For instance, such a frequency/period setting unit 68 sets a period of the sustaining pulse such that a sustaining pulse having a wider period as the APL is higher can be applied as shown in FIG. 5A to FIG. 7B. Herein, the frequency/period setting unit 68 sets a high width and/or low width of the sustaining pulse widely in proportion to the APL to thereby widen a period of the sustaining pulse.

The waveform generator 64 generates a timing control signal using the N-step signal inputted from the APL unit 62. At this time, the waveform generator 64 sets a frequency of the sustaining pulse on the basis of a frequency setting signal of the sustaining pulse applied from the frequency/period setting unit 68. The timing control signal generated from the waveform generator 64 is applied to the address driving IC, a scan driving IC and a sustain driving IC of the panel 66.

Figure 13:
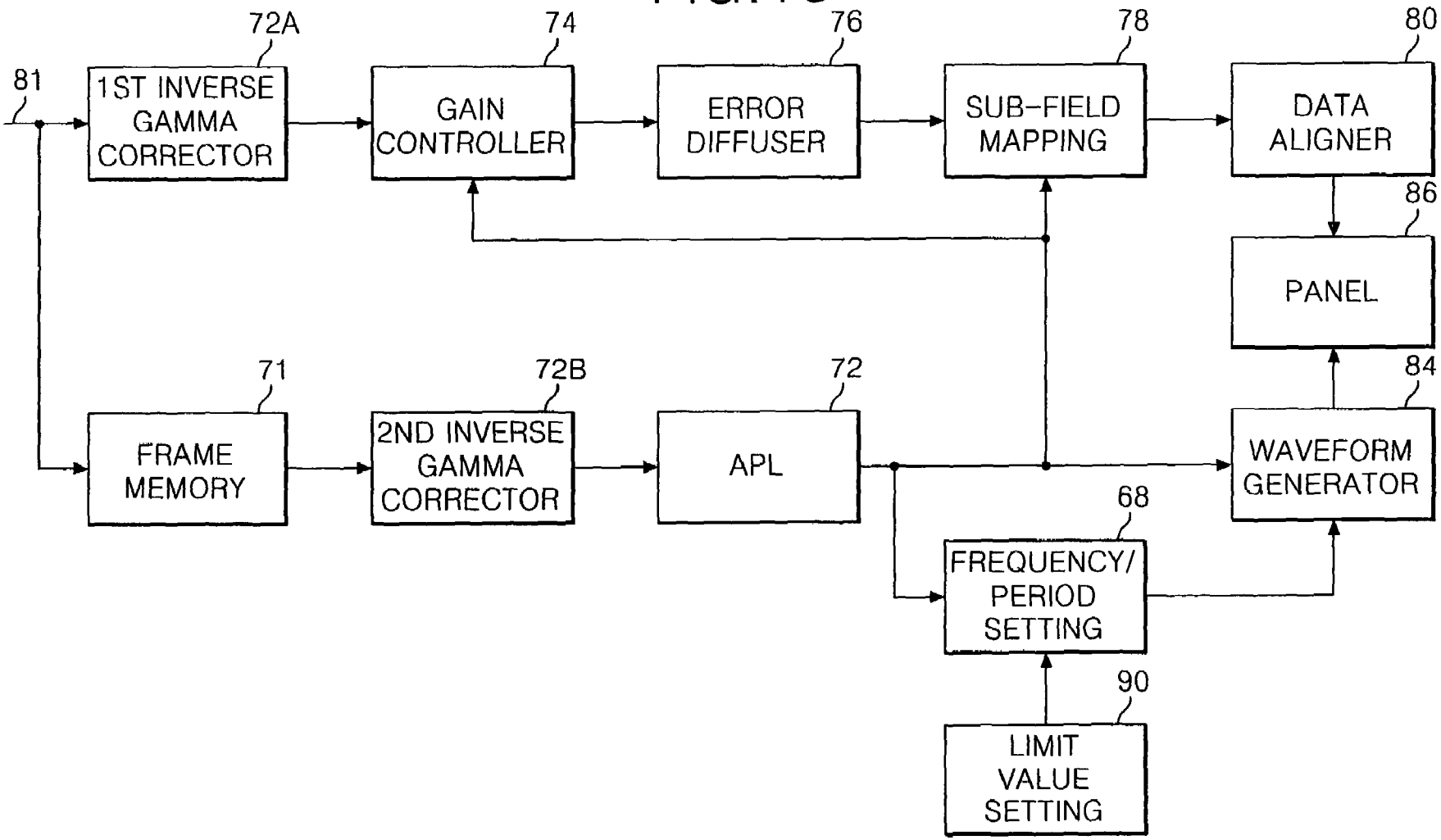
FIG. 13 is a block diagram showing a configuration of a plasma display panel driving apparatus according to another embodiment of the present invention.

FIG. 13 shows a PDP driving apparatus according to another embodiment of the present invention.

Referring to FIG. 13, the PDP driving apparatus includes a first inverse gamma corrector 72A, a gain controller 74, an error diffuser 76, a sub-field mapping unit 78 and a data aligner 80 that are connected between an input line 81 and a panel 86, and a frame memory 71, a second inverse gamma corrector 72B, an average picture level (APL) unit 72, a frequency/period setting unit 78, a limit value setting unit 90 and a waveform generator 84 that are connected between the input line 81 and the panel 86.

The first and second inverse gamma correctors 72A and 72B makes an inverse gamma correction of a gamma-corrected video signal to thereby linearly convert a brightness value according to a gray level value of the video signal. The frame memory 71 stores data R, G and B for one frame and applies the stored data to the second inverse gamma corrector 72B.

The APL unit 82 receives a video data corrected by the second inverse gamma corrector 72B to generate N-step signals (wherein N is an integer) for controlling the number of sustaining pulses. The gain controller 74 amplifies a video data corrected by the first inverse gamma corrector 72A by an effective gain.

The error diffuser 76 diffuses an error component of the cell into adjacent cells to make a fine adjustment of a brightness value. The sub-field mapping unit 78 re-assigns the corrected video data from the error diffuser 76 for each sub-field.

The data aligner 80 converts the video data inputted from the sub-field mapping unit 78 in such a manner to be suitable for making a resolution format of the panel 66, and applies it to an address driving integrated circuit (IC) of the panel 86.

The limit value setting unit 90 applies a maximum limit value and/or a minimum limit value to the frequency/period setting unit 88.

The frequency/period setting unit 88 determines a frequency/period of a sustaining pulse in correspondence with the APL applied from the APL unit 82. For instance, such a frequency/period setting unit 88 sets a frequency/period of the sustaining pulse such that a sustaining pulse having a wider period as the APL becomes higher as shown in FIG. 5A to FIG. 7B. Herein, the frequency/period setting unit 88 sets a high width and/or a low width of the sustaining pulse widely in proportion to the APL, thereby enlarging a period of the sustaining pulse. Further, the frequency/period setting unit 88 sets a frequency/period of the sustaining pulse as shown in FIG. 8A to FIG. 10B using a maximum limit value and/or a minimum limit value applied from the limit value setting unit 90.

The waveform generator 84 generates a timing control signal using the N-step signal inputted from the APL unit 82. At this time, the waveform generator 84 sets a frequency of the sustaining pulse on the basis of a frequency setting signal of the sustaining pulse applied from the frequency/period setting unit 88. The timing control signal generated from the waveform generator 84 is applied to the address driving IC, a scan driving IC and a sustain driving IC of the panel 86.

As described above, according to the present invention, a sustaining pulse having a wider period as the APL becomes higher is applied to thereby improve an emission efficiency. Furthermore, a large number of sustaining pulses can be applied at a low APL by setting a high minimum limit frequency, thereby improving a peak brightness of the panel. Moreover, according to the present invention, a maximum limit frequency is set such that a constant sustain margin can be assured, thereby causing a stable sustain discharge.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display panel, comprising:

setting a number of sustaining pulses in response to an average picture level; and setting a period of each sustaining pulse in proportion to said average picture level, the period of each sustaining pulse including a high width and a low width, the sustaining pulse having a wider period as the average picture level becomes higher, the wider period of the sustaining pulse being obtained by increasing a duration of the high width of the sustaining pulse in proportion to the average picture level and maintaining a duration of the low width of the sustaining pulse.

2. The method as claimed in claim 1, wherein said setting the number of sustaining pulses includes:

setting the number of sustaining pulses in inverse proportion to the average picture level.

3. The method as claimed in claim 1, wherein a maximum period of the sustaining pulse is wider, by approximately 0.5μs to 10μs, than a minimum period of the sustaining pulse.

4. The method as claimed in claim 1, wherein said period of the sustaining pulse is changed in at least a partial region of said average picture level.

5. The method as claimed in claim 4, further comprising:

setting a minimum limit frequency at more than a desired average picture level such that said period of the sustaining pulse is limited to less than a certain width.

6. The method as claimed in claim 5, wherein said minimum limit frequency is set such that a maximum period of the sustaining pulse is wider, by approximately 0.5μs to 10μs, than a minimum period of the sustaining pulse.

7. The method as claimed in claim 4, further comprising:

setting a maximum limit frequency at less than a desired average picture level such that said period of the sustaining pulse is limited to more than a certain width.

8. The method according to claim 1, wherein said period of the sustaining pulse is increased in a stepwise manner in accordance with the average picture level as said average picture level goes from a lower level to a higher level.

9. A method of driving a plasma display panel, comprising:

setting a number of sustaining pulses in response to an average picture level; and setting a period of each sustaining pulse in proportion to said average picture level, the period of each sustaining pulse including a high width and a low width, the sustaining pulse having a wider period as the average picture level becomes higher, the wider period being obtained by increasing a duration of the low width of the sustaining pulse in proportion to the average picture level and maintaining a duration of the high width of the sustaining pulse.

10. A method of driving a plasma display panel, comprising:

setting a number of sustaining pulses in response to an average picture level; and setting a high width of the sustaining pulse in proportion to said average picture level and maintaining a duration of the low width of the sustaining pulse, the high width being set such that the sustaining pulse has a wider period as the average picture level becomes higher.

11. The method as claimed in claim 10, wherein said high width of the sustaining pulse is changed in at least a partial region of said average picture level.

12. The method according to claim 10, where setting the high width occurs without setting the low width of the sustaining pulse in proportion to said average picture level.

13. A method of driving a plasma display panel, comprising:

setting a number of sustaining pulses in response to an average picture level; and setting a low width of the sustaining pulse in proportion to said average picture level and maintaining a duration of the high width of the sustaining pulse, the low width being set such that the sustaining pulse has a wider period as the average picture level becomes higher.

14. The method as claimed in claim 13, wherein said low width of the sustaining pulse is changed in at least a partial region of said average picture level.

15. The method according to claim 13, where setting the low width occurs without setting the high width of the sustaining pulse in proportion to said average picture level.

16. A driving apparatus for a plasma display panel, comprising:

average picture level means for setting an average picture level corresponding to a video data; and period setting means for setting a period of a sustaining pulse in such a manner to be in proportion to said average picture level set by the average picture level means, the sustaining pulse including a high width and a low width, the sustaining pulse having a wider period as the average picture level becomes higher, the wider period being obtained by increasing a duration of the high width of the sustaining pulse in proportion to the average picture level and by maintaining a duration of the low width of the sustaining pulse.

17. The driving apparatus as claimed in claim 16, further comprising:

limit value setting means for setting at least one of a maximum limit value capable of widening a period of the sustaining pulse and a minimum limit value capable of narrowing said period of the sustaining pulse.

18. The driving apparatus as claimed in claim 17, wherein said period setting means receives at least one of said maximum limit value and said minimum limit value to control said period of the sustaining pulse.

19. A driving apparatus for a plasma display panel, comprising:

average picture level means for setting an average picture level corresponding to a video data; and period setting means for setting a period of a sustaining pulse in such a manner to be in proportion to said average picture level set by the average picture level means, the sustaining pulse including a high width and a low width, the sustaining pulse having a wider period as the average picture level becomes higher, the wider period being obtained by increasing a duration of the low width of the sustaining pulse and by maintaining a duration of the high width of the sustaining pulse, wherein said period setting means sets the low width of the sustaining pulse in proportion to said average picture level.

* * * * *